US009121660B2

(12) United States Patent
Yang

(10) Patent No.: US 9,121,660 B2
(45) Date of Patent: Sep. 1, 2015

(54) HIGH SHOOTING SPEED DUAL-POWER GEAR STRUCTURE OF TOY GUN

(71) Applicant: Chung-Kuan Yang, Taipei (TW)

(72) Inventor: Chung-Kuan Yang, Taipei (TW)

(73) Assignee: UNICORN HOBBY CORPORATION, New Taipei (TW)

( * ) Notice: Subject to any disclaimer, the term of this patent is extended or adjusted under 35 U.S.C. 154(b) by 0 days.

(21) Appl. No.: 14/466,888

(22) Filed: Aug. 22, 2014

(65) Prior Publication Data

US 2015/0059724 A1 Mar. 5, 2015

(30) Foreign Application Priority Data

Aug. 27, 2013 (TW) ..... 102130648 A

(51) Int. Cl.
*F41B 11/00* (2013.01)
*F41B 11/646* (2013.01)

(52) U.S. Cl.
CPC ..... *F41B 11/646* (2013.01)

(58) Field of Classification Search
CPC ..... F41B 11/642; F41B 11/57; F41B 11/89; F41B 7/08; F41A 19/59
USPC ..... 42/54, 84; 124/54, 32, 60, 63, 64, 65, 124/66, 67, 71–77
See application file for complete search history.

(56) References Cited

U.S. PATENT DOCUMENTS 5,261,384 A * 11/1993 Hu ..... 124/66
6,564,788 B1 * 5/2003 Hu ..... 124/66
7,100,592 B1 * 9/2006 Yang ..... 124/67
7,841,329 B2 * 11/2010 Yang ..... 124/66
8,662,063 B2 * 3/2014 Hu ..... 124/41.1
8,800,541 B2 * 8/2014 Hu ..... 124/66
2005/0000505 A1 * 1/2005 Pedicini et al. ..... 124/63
2006/0231083 A1 * 10/2006 Tsurumoto ..... 124/66
2007/0289586 A1 * 12/2007 Tsurumoto ..... 124/73
2011/0214654 A1 * 9/2011 Lee et al. ..... 124/31

* cited by examiner

*Primary Examiner* — Troy Chambers
*Assistant Examiner* — Bridget Cochran
(74) *Attorney, Agent, or Firm* — Pro-TECHTOR International Services; Ian Oglesby

(57) ABSTRACT

A high shooting speed dual-power gear structure of toy gun disclosed mainly includes a compound gear and an interlocking member. The compound gear has fine gear uniformly distributed on one side and at the circumference thereof, and coarse gear partially and uniformly distributed on the other side and at the circumference thereof with an indentation formed at the portion without gear teeth. The fine gear being driven by a electromotor through a transmission component is capable of driving a piston to compress a piston spring during the rotating process. A gun bolt core tube having an L-shaped hook part is furnished at the outer circumference of the piston. Moreover, a second interlocking projecting pin capable of controlling the power source of the electromotor is furnished on a side of the compound gear. The interlocking member being attached to a side opposite to the second interlocking projecting pin of the compound gear has a first interlocking projecting pin that contacts the L-shaped hook part to drive the gun bolt core tube into the action of bullet loading. By having the first interlocking projecting pin and the second interlocking projecting pin be furnished on opposite sides of the compound gear, the action process and period between their contacting control can be enhanced to absorb the inertia rotation after the electromotor is powered off to avoid the occurrence of repeated bullet loading.

4 Claims, 9 Drawing Sheets

HIGH SHOOTING SPEED DUAL-POWER GEAR STRUCTURE OF TOY GUN

FIELD OF THE INVENTION

The invention relates to a high shooting speed dual-power gear structure of toy gun, and more particularly, to a high shooting speed dual-power gear structure of toy gun that is capable of effectively avoiding bullet loading repeatedly when it comes to triggering.

DESCRIPTION OF THE PRIOR ART

Among the current common toy gun products having projectile plastic bullet, there are pneumatic, and mechanical types of structure. The pneumatic type of toy gun makes use of an attached air bottle for providing the high-pressure gas to generate pressure propelled plastic (PP) bullets for projecting off the bullets. However, the mechanical type of toy gun makes use of the resilient spring force released from the compressed spring for propelling a piston to generate high-pressure gas for projecting off the bullets. Both types of toy gun have significant difference in structure since their power sources are different.

In the "Control structure of dual-power type toy gun" of the patent application of No. 1264518 of the publication of Taiwan, Republic of China, the inventor disclosed a toy gun structure combining both the manual and electromotor driven types. When it comes to practical application, the electromotor of this kind of combined type of toy gun structure will continue to drive the compound gear to rotate and come off the preset position when the power source is interrupted due to the inertia action. Another situation is that the side projecting pin preset on the compound gear hits the trigger and generate a reverse rotation and come off the preset position causing the electromotor unable to effectively mesh to drive resulting in either bullet-stuck or repeated bullet-loading such that two bullets are shot at a time.

For this reason, the same inventor has another patent application "Control structure of dual-power type toy gun (II)" of No. 1370893 of the publication of Taiwan, Republic of China, the inventor disclosed an improved toy gun structure that mainly includes a first connecting rod, a first pushing member, and a transmission set. One end of the first connecting rod is pivotally connected to the first pushing member while another end of the first connecting rod is connected to a trigger. The trigger is capable of actuating the first connecting rod to slide transversely and interlock a switch through the first pushing member making the switch turn on the power source of a electromotor. The transmission set has a compound gear, which is connected to the electromotor, has a resilient cantilever and an interlocking projecting pin positioned at the free end of the resilient cantilever. When it comes to practical application, the above-mentioned structures is capable of coordinating with the relevant mechanisms consisting a gun shell, a gun bolt core tube, and a piston to execute actions where the gun bolt core tube and the piston are positioned in the gun shell. The gun bolt core tube has an L-shaped hook part furnished on the motion path of the interlocking projecting pin while the piston having a rack corresponding to the compound gear furnished at the bottom thereof is at least partially stretched into the gun bolt core tube. When the power source of the electromotor is on, through the pivotally rotation, the piston is driven backward to be compressed to interlock the projecting pin to drive the gun bolt core tube backward through the L-shaped hook part so that a piece of bullet preset in the magazine drops to the ready-to-be-shot position in front of gun bolt core tube. Finally, as the compound gear is separated from the gear rack, the piston is restored back to the original position and the air in the gun bolt core tube is compressed to shoot off the bullet ready-to-be-shot.

However, in the actual action, in the course when the bullet is loaded, the gun bolt core tube and the piston are both in the compression process, thereby, the compression action of the piston will cause shaking of the gun bolt core tube that result in the bullet ready-to-be-shot persist an unstable period to wait for the piston to be completed the compression process before the shoot off action. As a result, the other bullets can continue to drop causing the occurrence of repeated loading of the bullets. This is the demerit of the prior art.

In view of the above-mentioned disadvantages of the charging structure of the electric toy guns of the prior art, the invention presents the improved ways to simplify and change the conceptual design of the module of the toy gun charging structure promising to extend its service life. This is the intention of the invention.

SUMMARY OF THE INVENTION

In view of the above-mentioned disadvantages of the electric toy guns of the prior art, the invention presents the improved ways to simplify and change the conceptual design of the module of the toy gun structure promising to improve the function of the toy gun structure. This is the intention of the invention.

The primary objective of the invention is to provide a high shooting speed dual-power gear structure of toy gun that by having the second interlocking projecting pin for controlling the power supply of the electromotor and the first interlocking projecting pin be furnished on opposite sides of the compound gear, the action process and period between their contacting control can be enhanced to absorb the inertia rotation after the electromotor is powered off to effectively avoid the occurrence of repeated bullet loading and improve the overall operating quality.

The secondary objective of the invention is to provide a high shooting speed dual-power gear structure of toy gun that is applicable to the internal structure of most of the conventional toy gun to achieve the effect of operating quality and has the efficacy of being capable of lowering the developing and manufacturing cost.

To achieve the above-mentioned objective, the invention provides a high shooting speed dual-power gear structure of toy gun disclosed mainly includes a compound gear and an interlocking member. The compound gear has fine gear uniformly distributed on one side and at the circumference thereof, and coarse gear partially and uniformly distributed on the other side and at the circumference thereof with an indentation formed at the portion without gear teeth. The fine gear being driven by a electromotor through a transmission component is capable of driving a piston to compress a piston spring during the rotating process. A gun bolt core tube having an L-shaped hook part is furnished at the outer circumference of the piston. Moreover, a second interlocking projecting pin capable of controlling the power source of the electromotor is furnished on a side of the compound gear. The interlocking member being attached to a side opposite to the second interlocking projecting pin of the compound gear has a first interlocking projecting pin that contacts the L-shaped hook part to drive the gun bolt core tube into the action of bullet loading. By having the first interlocking projecting pin and the second interlocking projecting pin be furnished on opposite sides of the compound gear, the action process and period between their contacting control can be enhanced to absorb the inertia rotation after the electromotor is powered off to avoid the occurrence of repeated bullet loading.

In accordance with the above-mentioned structure, the compound gear has a positioning indentation furnished thereat, and the interlocking component forms positioning status by having the interlocking component embedded the positioning indentation.

In accordance with the above-mentioned structure, a hollow indentation, furnished on the opposite side of the positioning indentation of the compound gear, has a resilient cantilever furnished therein, and a second interlocking projecting pin which is oppositely projected from the first interlocking projecting pin is also furnished at the free end of the resilient cantilever.

In accordance with the above-mentioned structure, the coarse gear is connected to the fine gear.

The accomplishment of this and other objectives of the invention will become apparent from the following description and its accompanying drawings of which:

DETAILED DESCRIPTION OF THE PREFERRED EMBODIMENT

Figure 1:
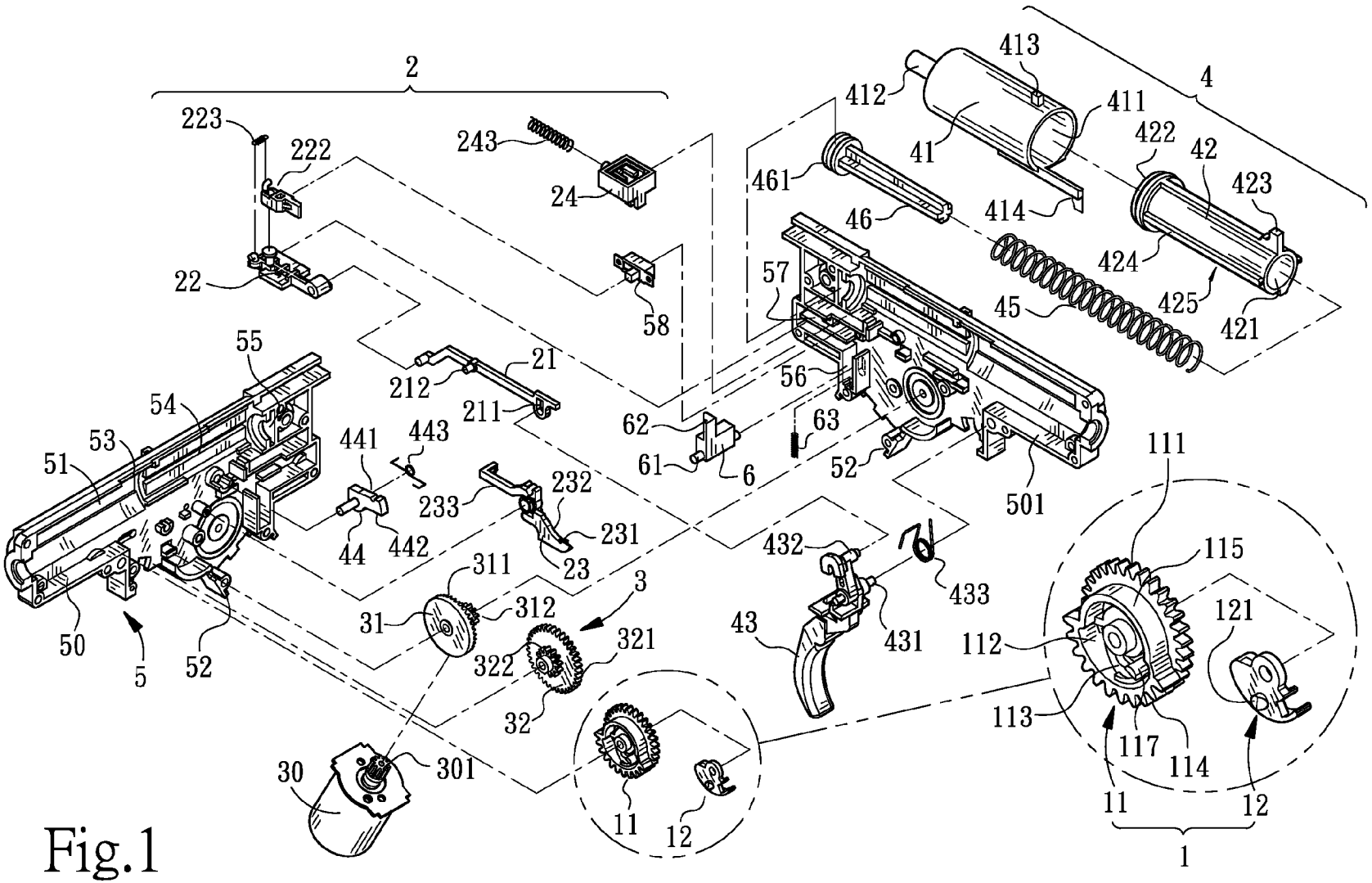
FIG. 1 is an isometric and exploded view of the high shooting speed dual-power gear structure of toy gun of the invention.
Figure 2:
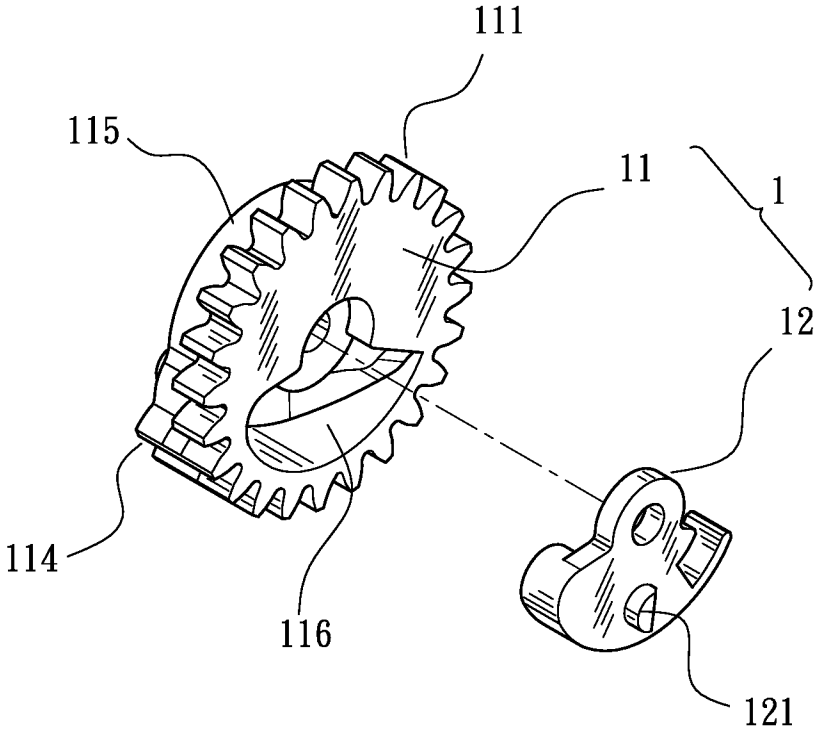
FIG. 2 is an isometric view of the driving component the invention.
Figure 3:
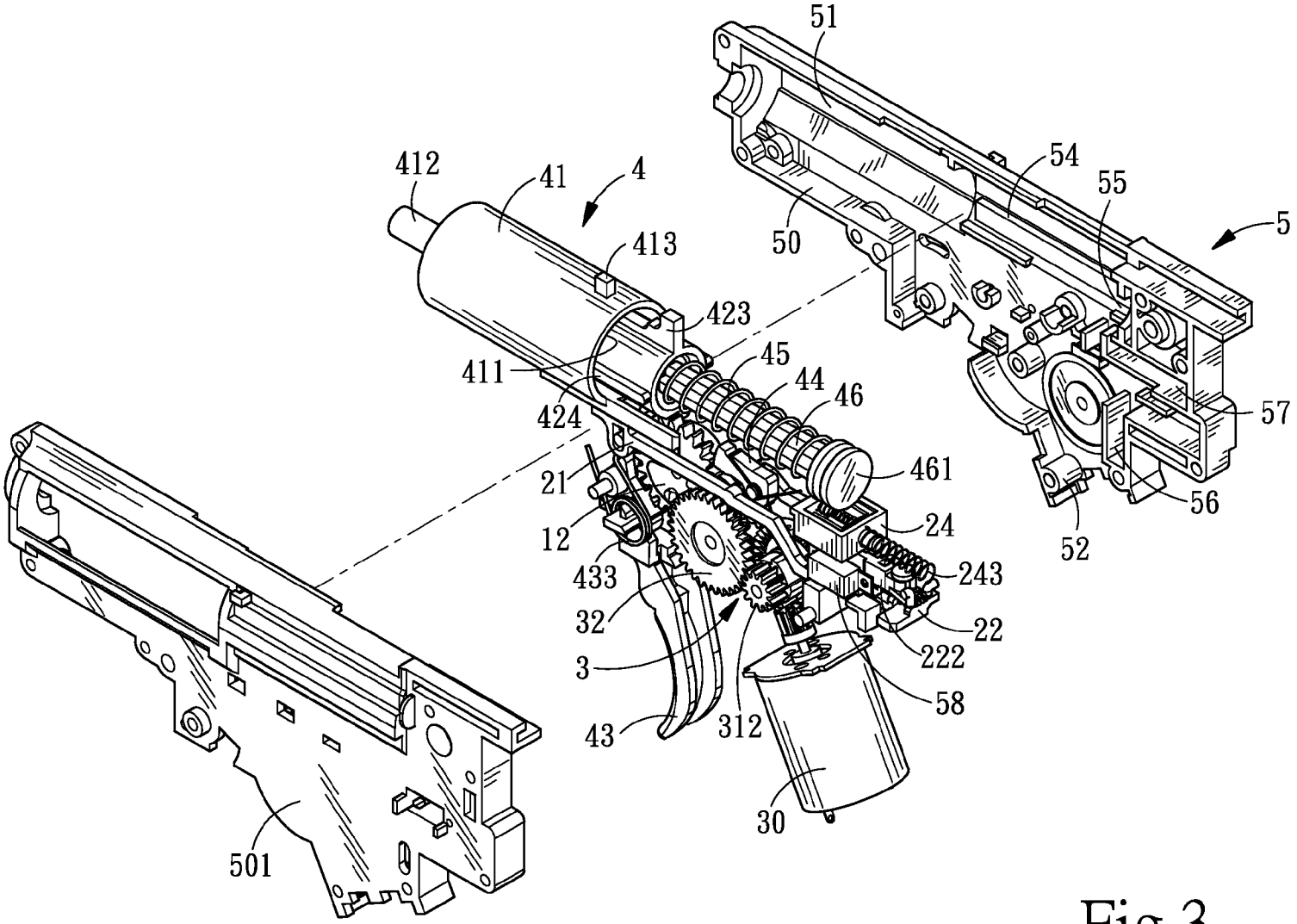
FIG. 3 is an isometric and schematic view of a partial assembly of the invention.
Figure 4:
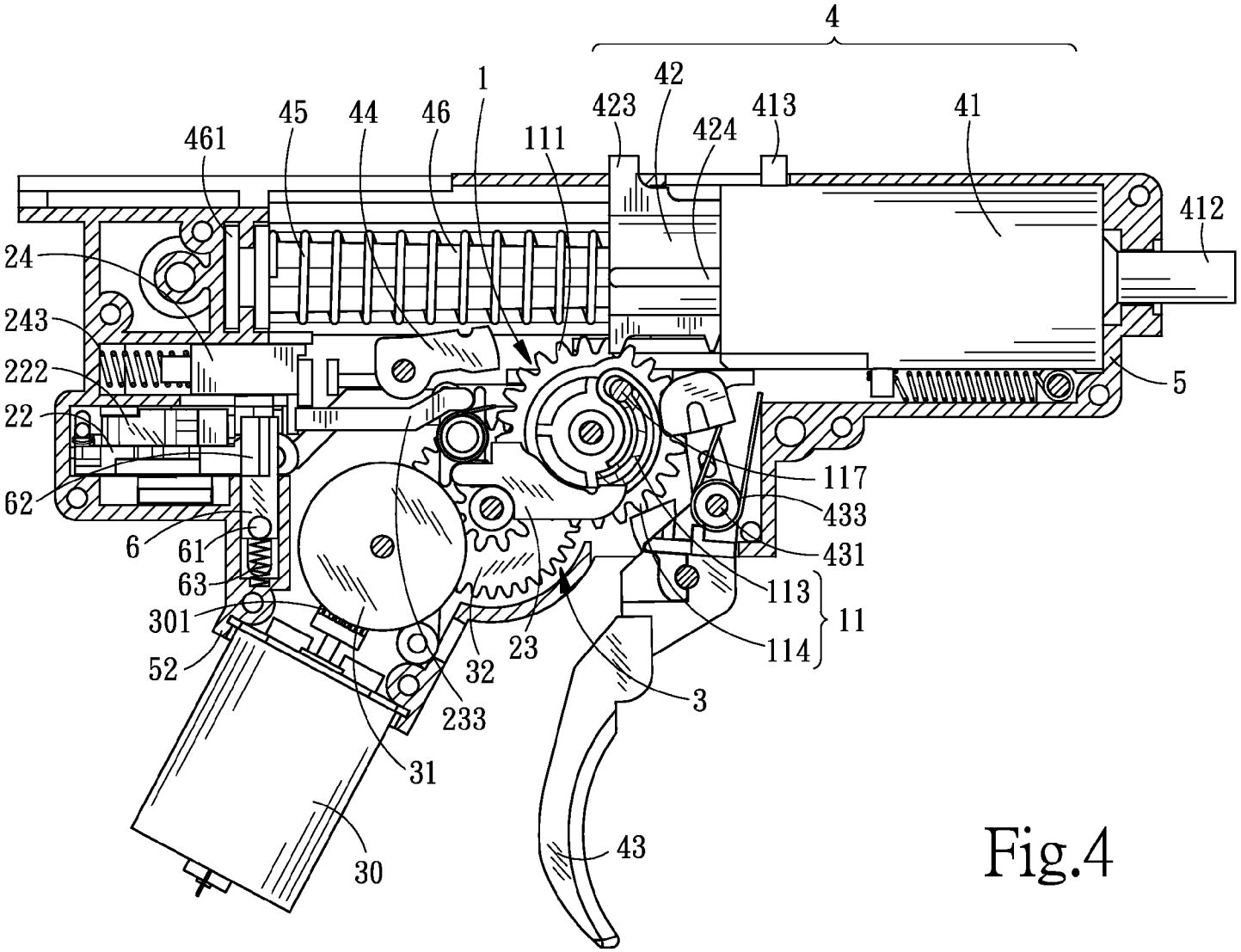
FIG. 4 is a longitudinal cross-sectional view of the assembly of the invention.

FIG. 1 is an isometric and exploded view of the high shooting speed dual-power gear structure of toy gun of the invention; FIG. 2 is an isometric view of the driving component the invention; FIG. 3 is an isometric and schematic view of a partial assembly of the invention; while FIG. 4 is a longitudinal cross-sectional view of the assembly of the invention. As shown in FIG. 1, FIG. 2, FIG. 3, and FIG. 4, the high shooting speed dual-power gear structure of toy gun of the invention mainly includes a driving component (1) and an interlocking component (2) wherein the driving components (1) are consisted of a compound gear (11) and an interlocking member (12). The compound gear (11) has fine gear (111) uniformly distributed on one side and at the circumference thereof, and coarse gear (114) partially and uniformly distributed on the other side and at the circumference thereof with an indentation (115) formed at the portion without gear teeth. Moreover, the compound gear (11) has a hollow indentation (112) furnished on one side thereof and a positioning indentation (116) furnished on the other side thereof. The hollow indentation (112) has a resilient cantilever (113) with a second interlocking projecting pin (117) furnished at the free end thereat, and the interlocking member (12) being capable of being embedded and tightly sealed in the positioning indentation (116) (see FIG. 2) has a first interlocking projecting pin (121) reversely stretched to the second interlocking projecting pin (117) at the portion revealed from the portion of the positioning indentation (116).

In actual application, the above-mentioned structure of the invention can be embodied in association with some relevant mechanism such as an interlocking component (2), a transmission component (3), a triggering device (4), and gun shell (5) etc. In a feasible embodiment, the gun shell (5) is relatively combined by two half-gun-shells (50), (501). Furnished up above in the gun shell (5), there are hollow part (51) and inner guided channel (54) connected each other with a front guided channel (53) furnished above the area between them. There are also a positioning channel (55) furnished at the end of the inner guided channel (54), a motor connecting end (52) furnished below the gun shell (5), a horizontally-extended switch containing chamber (57), and a vertically-extended control guided channel (56) furnished in the two half-gun-shell (501) and closed to and below the positioning channel (55), as well as a power switch (58) furnished in the switch containing chamber (57) and connected to a push-throwing piece (222).

The interlocking component (2) is consisted of a first connecting rod (21), a first interlocking member (22), a second connecting rod (23), and a second interlocking member (24). The first connecting rod (21) having a spring (not shown in the Figure) to be employed to prop against within the gun shell (5) for making it to slide along while keeping in resilient status has a connecting hole (211) (a long hole) furnished at one end and has the other end be pivotally connected to an end of the first interlocking member (22). Moreover, there are also a first interlocking projecting pin (121) furnished at the middle section of the first connecting rod (21), the push-throwing piece (222) pivotally furnished at the first interlocking member (22), as well as a first restoring spring (223) furnished between the first interlocking member (22) and the push-throwing piece (222). An end of the second connecting rod (23) is pivotally connected to a push rod (233) through a connecting member (not shown in the Figure) which is again pivotally connected to a portion near and below the inner guided channel (54) of the gun shell (5). Through the pivotally rotating of the connecting member, it is possible to make the second connecting rod (23) and the push rod (233) rotates in reverse direction. What is more, there are a hook part (231) and an arcuate surface (232) furnished at the second connecting rod (23) where the hook part (231) is positioned at an end of the arcuate surface (232). Furthermore, the second interlocking member (24) has a second restoring spring (243) furnished on a side thereof and propped against within the gun shell (5). Through the pivotally rotating of the connecting member, it is possible to make the second connecting rod (23) and the push rod (233) rotate in reverse direction. What is more, there are a hook part (231) and a arcuate surface (232) furnished at the second connecting rod (23) where the hook part (231) is positioned at an end of the arcuate surface (232). Further more, the second interlocking member (24) has a second restoring spring (243) furnished on a side thereof and propped against within the gun shell (5).

The high shooting speed dual-power gear structure of toy gun of the invention also has a transmission component (3)

that consists of a first combining gear (31) and a second combining gear (32). The first combining gear (31) has a rectangular gear (311) meshing with a transmission gear (301) for the power output of a preset electromotor (30) that is furnished at the motor connecting end (52) while the front gear (312) is furnished on a side surface of the rectangular gear (311). The second combining gear (32) has a concentric large gear (321) and pinion (322) where the large gear (321) is meshed with the front gear (312) of the first combining gear (31) while the pinion (322) is meshed with the fine gear (111) of the compound gear (11).

The triggering device (4) is consisted of a gun bolt core tube (41), a piston (42), a trigger (43), a pivotally rotating block (44), a piston spring (45) and a plunger (46). The gun bolt core tube (41) being contained in the hollow part (51) of the gun shell (5) has a piston containing space (411) furnished at an end thereof and with an opening. The gun bolt core tube (41) has a salient part (32) and an L-shaped hook part (414) furnished respectively at the outer circumference thereof where the salient part (32) is capable of stretching into the front guided channel (53) of the gun shell (5) to form a action limit. The piston (42) has its one end combine with a piston washer (422) and stretch into the piston containing space (411) of the gun bolt core tube (41), as well as has its other end furnish with a plunger containing space (421) with an opening where the plunger containing space (421) is capable of containing an end of the plunger (46) to be stretched in after being slipped on a piston spring (45). The plunger containing space (421) has a shuttering salient part (423) furnished on the top side and close to the open end thereof. Moreover, at the outer circumference of the piston (42), a plurality of side ribs (424) and a gear rack (425) axially extended are furnished thereof where the side rib (424) is capable of stretching into the inner guided channel (54) and sliding therein while the gear rack (425) is furnished on the pivotally rotating path of the coarse gear (114) of the above-mentioned compound gear (11). A circumferential flange (461) furnished at an end part, which is exposed out of the piston (42), of the plunger (46) is capable of embedding in the positioning channel (55) of the gun shell (5) to form positioning. The trigger (43) being pivotally furnished at the gun shell (5) through a rotating shaft (431) maintains pivotally rotating resilient force by combining a first torsion spring (433). A side projecting pin (432) being furnished above the trigger (43) is capable of stretching into a connecting hole (211) (long hole) to form an interlocking status. The pivotally rotating block (44) being pivotally connected to the position below the piston (42) in the gun shell (5) has a catch tooth part (441) and a cant (442) furnished at both ends thereof where the cant (442) is contacted with the first projecting pin (212) of the first connecting rod (21). Moreover, the pivotally rotating block (44) is capable of maintaining in resilient condition by employing a second torsion spring (443).

What is more, a propping block (6) furnished in the control guided channel (56) of the gun shell (5) has a compression spring (63) provided at the bottom thereof, a toggling projecting block (61) provided at the top of the compression spring (63) therein and is transversely projected out of the control guided channel (56), as well as a shuttering part (62) furnished at the top thereof where the shuttering part (62) is leaned against the first interlocking member (22) and the second interlocking member (24).

Figure 5:
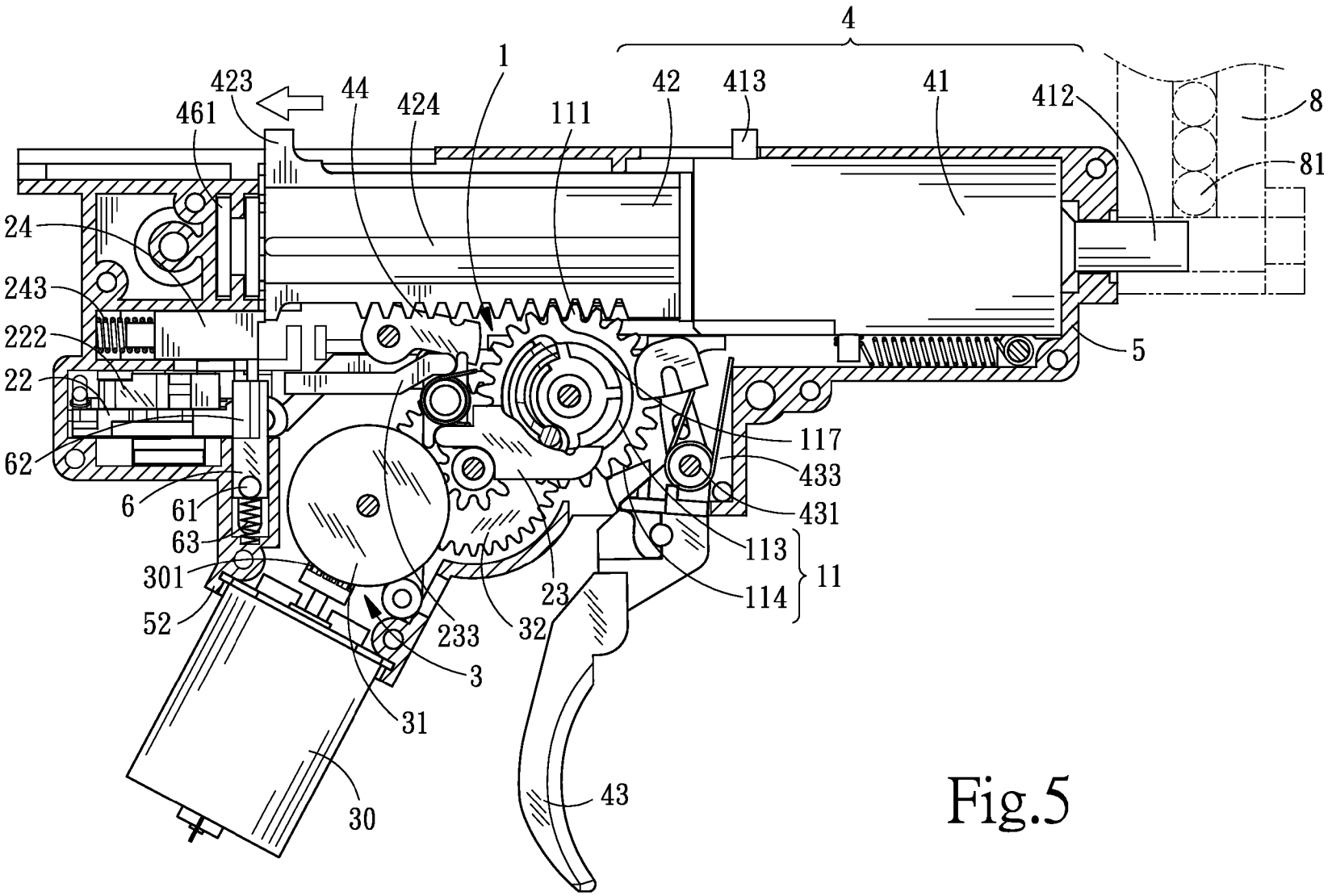
FIG. 5 is a schematic and longitudinal cross-sectional view of the assembly of the invention showing the electrically shooting action (I) of the invention.
Figure 6:
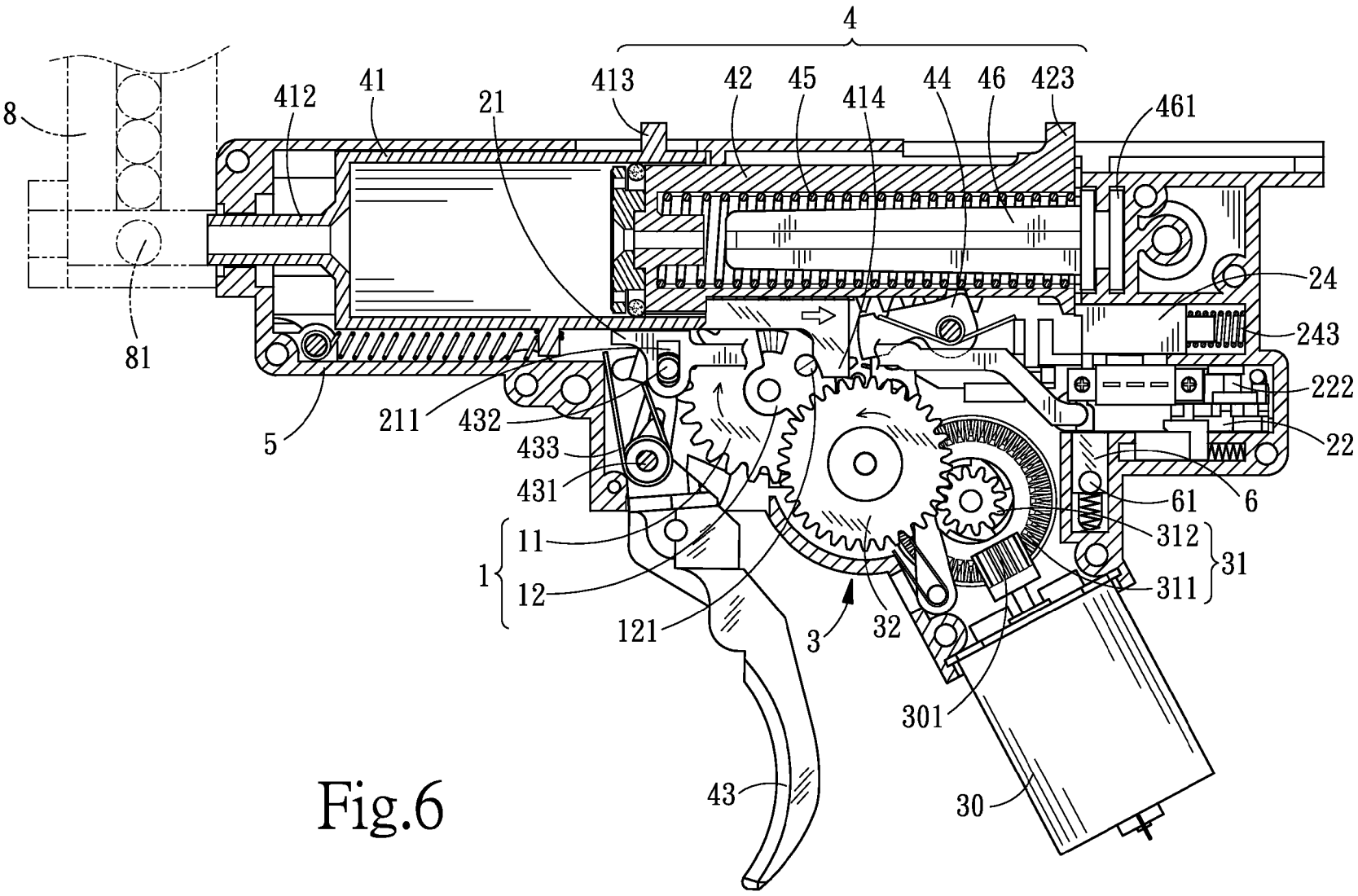
FIG. 6 is a schematic and longitudinal cross-sectional view of the assembly of the invention showing the electrically shooting action (II) of the invention.
Figure 7:
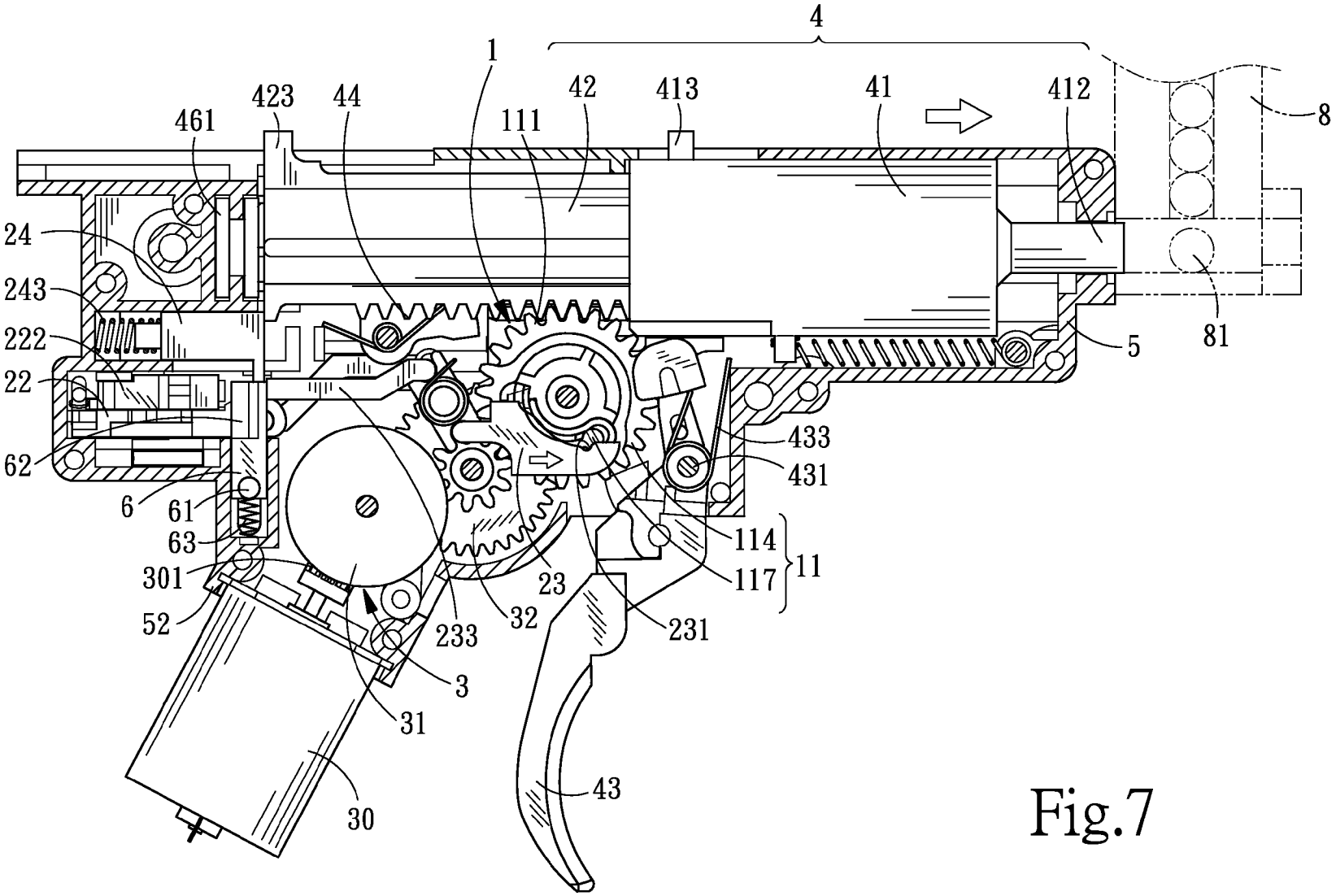
FIG. 7 is a schematic and longitudinal cross-sectional view of the assembly of the invention showing the electrically shooting action (III) of the invention.
Figure 8:
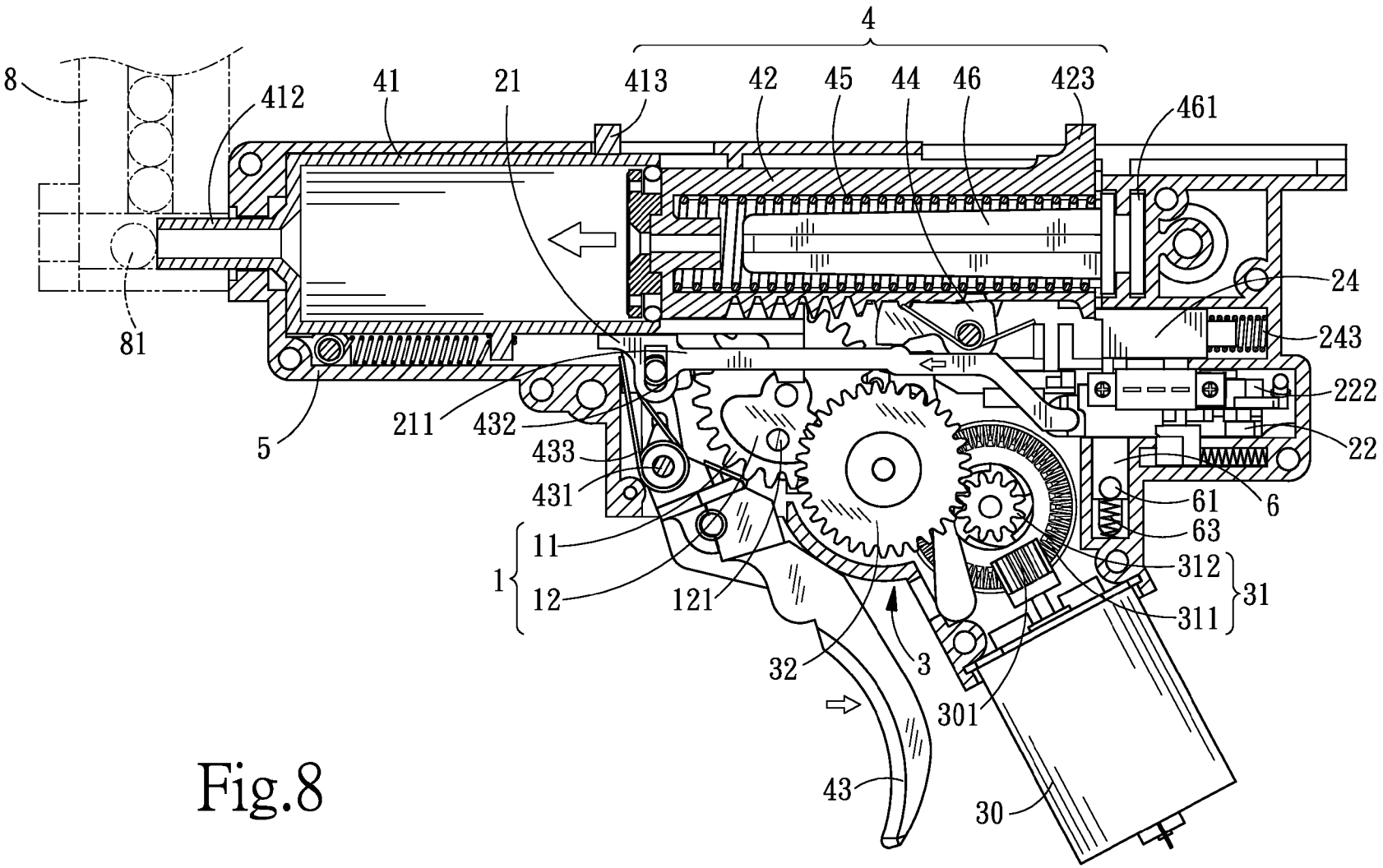
FIG. 8 is a schematic and longitudinal cross-sectional view of the assembly of the invention showing the electrically shooting action (IV) of the invention.
Figure 9:
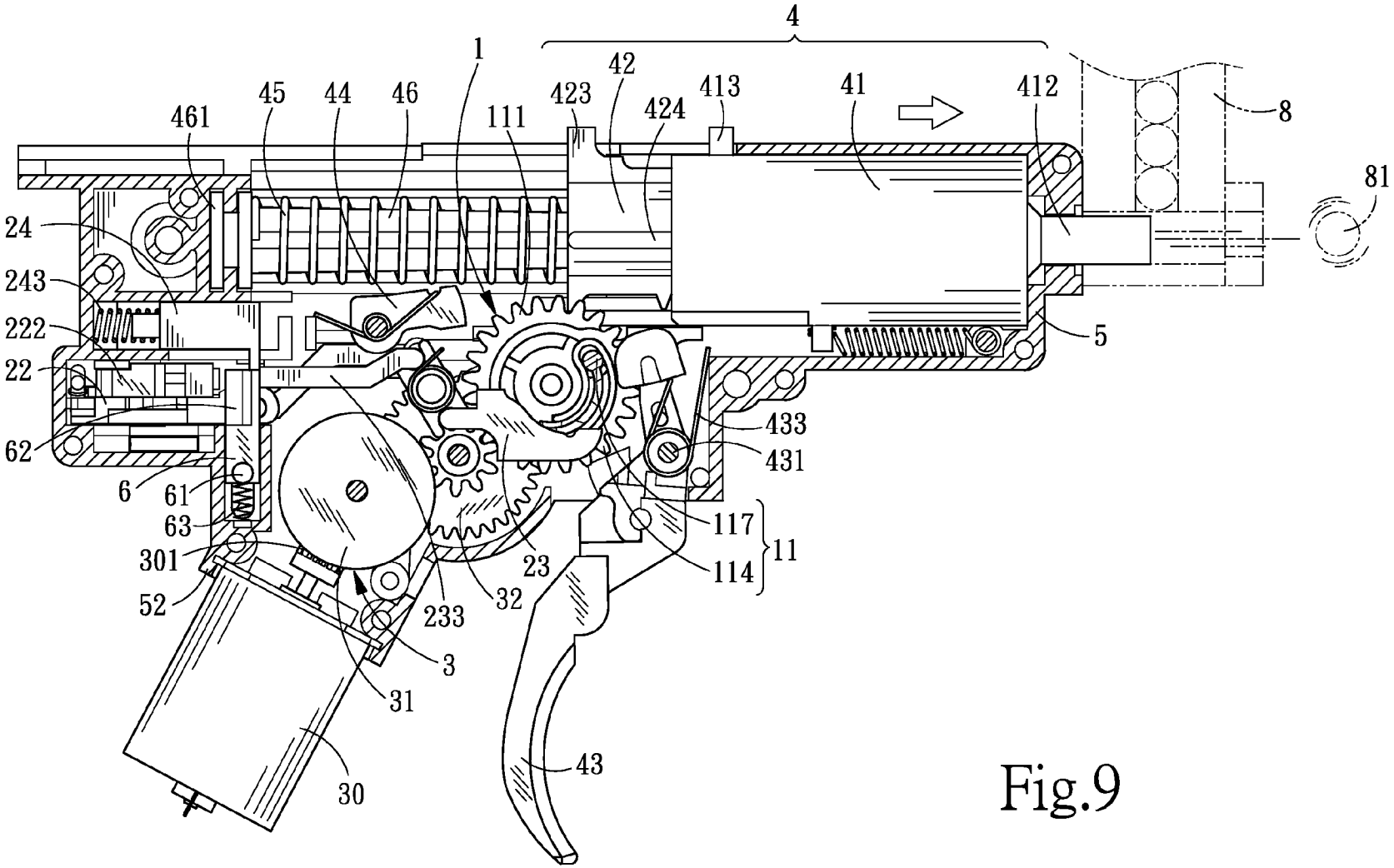
FIG. 9 is a schematic and longitudinal cross-sectional view of the assembly of the invention showing the electrically shooting action (V) of the invention.

FIG. 5 is a schematic and longitudinal cross-sectional view of the assembly of the invention showing the electrically shooting action (I) of the invention; FIG. 6 is a schematic and longitudinal cross-sectional view of the assembly of the invention showing the electrically shooting action (II) of the invention; FIG. 7 is a schematic and longitudinal cross-sectional view of the assembly of the invention showing the electrically shooting action (III) of the invention; and FIG. 8 is a schematic and longitudinal cross-sectional view of the assembly of the invention showing the electrically shooting action (IV) of the invention. As shown in FIG. 5, FIG. 6, FIG. 7, and FIG. 8, when it comes to electrically-actuated single-bullet shooting action, as the power switch (58) (not shown in the Figure) is switched on in connecting to the power source of the electromotor (30) and through the transmission gear (301), the electromotor (30) is capable of driving the first combining gear (31), the second combining gear (32), and interlocking the driving component (1) making its compound gear (11) start to rotate. At this moment, the coarse gear (114) of the compound gear (11) will first drive the piston (42) (compress the piston spring (45)) through the gear rack (425) to slide an appropriate distance and has the catch tooth part (441) of the pivotally rotating block (44) embed in the gear rack (425) to form positioning (as shown in FIG. 5,). In the mean time, the first interlocking projecting pin (121) pushes the gun bolt core tube (41) inwardly to make the bullet (81) in the magazine (8) in front of the gas nozzle (412) in the gun bolt core tube (41) drop at the preset position in front of the gas nozzle (412) for completing the bullet loading action (as shown in FIG. 6, at this moment, the compound gear (11) has its indentation (115) correspond to the gear rack (425), therefore, the piston (42) is still maintain in compressed positioning without continuing sliding). As the compound gear (11) persists rotating making the first interlocking projecting pin (121) separate from the L-shaped hook part (414), the gun bolt core tube (41) can be restored back to the original position that stops the dropping of the bullet (81) stored in the magazine (8). In the mean time, the second interlocking projecting pin (117) stretches into the hook part (231) to drive the second connecting rod (23), interlock the power switch (58) through the push rod (233) and cut off the power source of the electromotor (30). Due to the inertia action, the rotation of the electromotor (30) will not stop immediately after the power source is turned off but will drive the driving component (1) to persist rotating a short stroke to make the second interlocking projecting pin (117) separate from the hook part (231) (as shown in FIG. 7). In the mean time, in order to prevent the gun bolt core tube (41) from the action of being concave to shrink so as to preclude the defect of repeated bullet loading, the first interlocking projecting pin (121) can either rotate another angle or stop before contacting the L-shaped hook part (414) again (as shown in FIG. 8). When the trigger (43) is pressed, it will interlock the first projecting pin (212) of the first connecting rod (21) to push the cant (442) making the catch tooth part (441) of the pivotally rotating block (44) separate from the gear rack (425) so as to release the lock-checking to the piston (42). Subjected to the resilient action of the piston spring (45), the piston (42) is capable of quickly compressing the air contained in the gun bolt core tube (41) such that the air is sprayed out from the gas nozzle (412) to outwardly blow the bullet (81) positioned in front of the gas nozzle (412) to complete the electrically-actuated single-bullet shooting action.

The above-mentioned structure of the invention employs the design having the second interlocking projecting pin (117) and first interlocking projecting pin (121) furnished on each side of the compound gear (11) respectively making the second interlocking projecting pin (117) and the first interlocking projecting pin (121) have relatively longer rotating strokes and periods respectively to absorb the rotating inertia after the electromotor (30) is interrupted so as to further improve the design of the prior art that employs single components to drive respectively the two mechanism causing relatively shorter stroke and period of each of the rotation that results in the situation easily having repeatedly loading the bullets due to the inertia action.

when it comes to the electrically-actuated persistently shooting action, each of the individual actions of the second interlocking projecting pin (117) and the first interlocking projecting pin (121) is the same as the above-mentioned action of the single-bullet shooting. The only difference lie in the fact that there is another control mechanism that is capable of maintaining power supply of the electromotor (30) without being interrupted by the power switch (58) making the electromotor (30) capable of performing persistent rotation to load the bullets persistly in coordinating with the first interlocking projecting pin (121) to drive the gun bolt core tube (41) through the L-shaped hook part (414) so as to complete the action of electrically-actuated persistently shooting.

CONCLUSION

It is understood from the above-mentioned description that the high shooting speed dual-power gear structure of toy gun of the invention is for sure having the efficacy of avoiding repeatedly loading bullets while it is triggering. This is advantage of the invention.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A high shooting speed dual-power gear structure of toy gun disposed inside of a toy gun shell, comprising a driving component consisted of:

(a) a compound gear of said toy gun further comprising:

a fine gear for said toy gun furnished by distributing at the circumference of the compound gear, and connecting with an electromotor (30) through a transmission component to form a combination for driving the rotation of the compound gear; and a coarse gear for said toy gun having an indentation without furnishing teeth, and the coarse gear is capable of meshing with a gear rack preset in a piston to drive the piston for compressing a piston spring during the process as the coarse gear rotates with the compound gear where the piston further having a gun bolt core tube furnished at the outer circumference thereof where the gun bolt core tube further having an L-shaped hook part; and (b) an interlocking member of said compound gear for said toy gun having a first interlocking projecting pin stretching out of the compound gear, and the L-shaped hook part is furnished on the pivotally rotating path of the first interlocking projecting pin which begins to contact the L-shaped hook part when the piston approaches completely compressing the piston spring, so that said L-shaped hook drives said gun bolt core tube into an action, thereby loading a bullet into said toy gun.

2. The high shooting speed dual-power gear structure of toy gun as claimed in claim 1, wherein the compound gear has a positioning indentation furnished thereat, and the interlocking member forms a positioning status by having the interlocking member embedded in the positioning indentation.

3. The high shooting speed dual-power gear structure of toy gun as claimed in claim 1, wherein a hollow indentation, furnished on the opposite side of the positioning indentation of the compound gear, has a resilient cantilever furnished therein, and a second interlocking projecting pin which is oppositely projected from the first interlocking projecting pin is also furnished at the free end of the resilient cantilever.

4. The high shooting speed dual-power gear structure of toy gun as claimed in claim 1, wherein the coarse gear is connected to the fine gear.

* * * * *